US005396706A

United States Patent [19]

Fajnsztajn

[11] Patent Number: 5,396,706

[45] Date of Patent: Mar. 14, 1995

[54] GUARD FOR PORTABLE CIRCULAR SAWS

[76] Inventor: Aleksander Fajnsztajn, P.O. Box 6684, San Rafael, Calif. 94903

[21] Appl. No.: 177,225

[22] Filed: Jan. 4, 1994

Related U.S. Application Data

[63] Continuation-in-part of Ser. No. 120,571, Aug. 23, 1993, Pat. No. 5,361,501.

[51] Int. Cl.[6] ..... B27B 9/00

[52] U.S. Cl. ..... 30/391; 144/251 R

[58] Field of Search ..... 30/391, 371; 144/251 R

[56] References Cited

U.S. PATENT DOCUMENTS 3,701,369 10/1972 Gronke et al. ..... 30/391

*Primary Examiner*—W. Donald Bray

*Attorney, Agent, or Firm*—Harold D. Messner

[57] ABSTRACT

A portable, circular saw is disclosed. It includes a saw blade selectively rotatable about an axis of rotation to a define a working plane normal to such axis of rotation. The saw also includes an arcuate outer guard fixedly mounted about one side of the blade, and an inner guard having a central opening concentric of the axis of rotation. The purpose of the central opening is to permit the inner guard to be rotatably mounted about an opposite side of the blade. Also attached to the inner guard is a bulbous member that includes a leading edge that is adjacent to the cutting path of blade vis-a-vis a wooden member. Such wooden member generates a force on the inner guard as the former makes contact therewith and wherein the inner guard undergoes rotation about the axis of rotation. The bulbous member aids in the occurrence of such rotation by the fact that it substantially increases the engaging extent of the inner guard by a factor of at least 2 whereby jamming of rotation of the inner guard is prevented irrespective of position of the wooden member with respect to the inner guard.

18 Claims, 4 Drawing Sheets

GUARD FOR PORTABLE CIRCULAR SAWS

This application is a continuation-in-part of Ser. No. 08/120,571, filed Aug. 23, 1993, for "improved guard for power circle saw", now U.S. Pat. No. 5,361,501.

FIELD OF INVENTION

This invention relates to power driven circular saws and to guards used to provide safety in their use. These are commonly known in the art as "portable, circular saws" as below fully described.

BACKGROUND OF THE INVENTION AND PRIOR ART

Applicant is not aware of any prior art directed to improve the safety of saws of this class other than that on well known construction in which an upper and lower guard are positioned to surround the blades of the circle saw, the lower guard being constructed to surround the lower cutting portion of the saw and to telescope within the upper guard, surrounding it as the saw advances. The summary of the prior art is illustrated on FIG. 1.

It has been found that as the piece being cut advances along the saw and the lower guard advances to protect it, the wooden chips, lower guard and saw are inclined to jam preventing further progress of the saw and requiring release of the upper jaw. This is especially true of cutting small pieces or cutting on an incline where release of the upper guard creates a hazard. This jamming prevents movement of the piece to be cut within the lower guard. That is to say, because the lower inner guard has coextensive upright sections of differing shape at both leading and trailing edges, the workpiece can have a combination of height and end edge location that allows the workpiece to bypass contact with both leading edges of the lower guard and only make jamming contact with the trailing edge of the less upright and shorter section of the lower guard.

I have invented a device which I choose to call a "movement augmenter" which attaches to the lower guard and is positioned so that it permits movement of the lower guard and prevents jamming. The device comprised a thin cylindrical disc which attaches to the lower guard and assists in pushing the latter forward by the action of the piece being cut and releases the jamming between blade, guard and chips. This is shown separable at 12 and held in position by screws 13 through openings 13*a* (FIG. 3 against guard 5 or cast integral with guard 5 as shown on FIG. 5.

DESCRIPTION OF A PREFERRED EMBODIMENT

Figure 1:
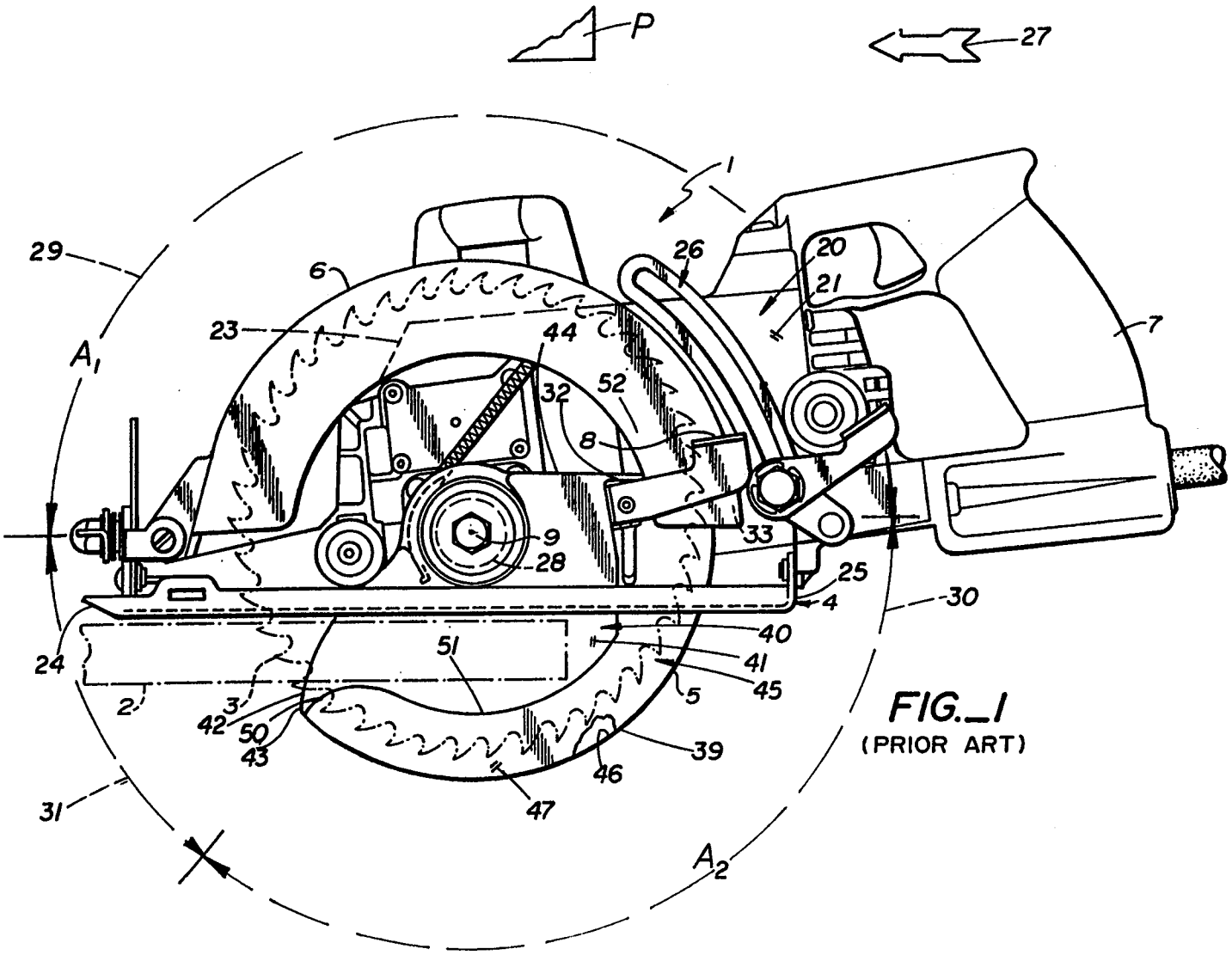
FIG. 1 (PRIOR ART)
FIG. 1: Side view of an existing machine without guard improvement (prior art).

Referring now to the figures, the total assembly of the machine or tool as ordinarily used in the trade and sometimes referred to as a "portable, circular saw" is designated as 1.

The item to cut out which may be a wooden member is shown at 2 and shown advancing against rotating blade 3 travelling on slide member 4 and protected by inner guard 5 protecting blade 3 and arranged for telescoping motion inside outer guard 6, spring loaded by control 8.

The operating handle of the portable unit is shown at 7.

An engaging edge 50 is provided at the receiving end of the inner guard to aid in starting the operation.

I have found that in order to function efficiently the augmenter 12 or 12*a* may be of any convenient thickness such as $\frac{1}{8}''$ and a circumference of $2\frac{3}{4}''$. It should be located so that its outer periphery is close to but does not engage the mounting nut 9.

The disc should further be located so that its outer circumference would be located in close proximity to the outer edge of the inner guard of the order of magnitude of $\frac{1}{2}''$ to $\frac{3}{4}''$ depending on the tool itself. The main thing is to base the point of the augmenter to rotate the inner guard as the saw progresses.

MODIFICATION

Saws of the class defined above, can also be described as portable, hand-held circular saws of the type having an axis of rotation A—A for blade 3 (of the saw 1 of FIG. 1) that is coincident with an axis of formation of inner guard 5. The blade 3 defines a working plane P that is normal to the axis of rotation A—A.

Note further that the saw 1 of FIG. 1 includes a motor housing 20 having a rear section 21 that includes handle 7 for hand manipulation of the saw 1 and a forward section 23 connected to a forward end 24 of the planar deck member 4 through fixedly mounted outer guard 6. A rearward end 25 of the deck member 4 is connected to rear section 21 via a slide mechanism 26 which adjusts the depth of cut of the blade 3 relative to the deck member 4.

In operations, the saw 1 is capable of undergoing rectilinear motion relative to the wooden member 2, in the direction of arrow 27. An electric motor (not shown) is housed within the housing 20 for causing rotation of the blade 3 via a shaft 28 terminating in a mounting nut 9. The blade 3 is attached to the shaft 28 and rotates in cooperation with the shaft 28.

The arcuately shaped outer guard 6 is fixedly mounted to the housing 20 and encloses a first sector 29 of the blade 3 having an angular dimension or angle A1 of about 180 degrees.

The inner guard 5 is rotatably mounted to the shaft 28 coincident with the axis of rotation A—A of the blade 3 but is clear of making axial contact with the mounting nut 9 so the inner guard 5 can rotate about the axis A—A. But in its relaxed state, the inner guard 5 encloses a second sector 30 of the blade 3 on a side opposite to the first sector 29, such second sector 30 defining an angular dimension or angle A2 which is about 120 degrees. Note that there is a third or cutting sector 31 of the blade 3 wherein the latter is radially clear of both the inner and outer guards 5, 6 defining an angle A3 of about 60 degrees. The cutting sector 31 is positioned adjacent to the forward end 24 of the deck member 4.

In operations, the cutting sector 31 is capable of expansion as the wooden member 2 generates a force on the inner guard 5 as explained below. Under such circumstances, the inner guard 5 undergoes rotation about the axis of rotation A—A to causes a rear end 32 of the inner guard 5 to be displaced along cavity 33 interior of the outer guard 6. The amount of such displacement is a function of force applied to the inner guard 5 by the wooden member 2.

Structurally, the inner guard 5 also includes an planar upright pie shaped member 40 offset to one side of the working plane P of the blade 3, and defining a broad surface 41 terminating in a curved lower edge 39, a forward edge 42 integrally connected to the curved edge 39 at an origin corner 43 and a rearward edge 44 integrally connected to the curved edge 39. The inner guard 5 also includes an upright lip member 45 integrally connected to and cantilevered from the curved edge 39, such lip member 45 including an upright longitudinal leg section 46 coextensive with the broad surface 41 of the planar pie shaped upright section member 40. The lip member 45 also includes a transverse leg section 47 wherein the section member 40 is rotatable mounted to the shaft 28 while the longitudinal leg section 46 depends from the section member 40 through the transverse leg section 47. That is, the transverse leg section 47 is integrally attached to the following: at one end to curved edge 39 of the section member 40, and at the other end, to longitudinal leg section 46. The transverse leg section 47 is normal to the longitudinal leg section 46 and extends toward the front of the inner guard 5 to form a terminal edge 50. At the region of the lip member 45 that is coincident with origin corner 43 of the upright member 40, note that terminal edge 50 also includes a portion of the longitudinal leg section 46, viz., along a line that intersects the working plane P at ninety degrees as well as is coincident with the origin corner 43. The leading edge 50 is also positioned adjacent to the forward edge 42 of the planar member 40. Note that the leading edge 50 permits engagement with the wooden member 2. Note that the transverse leg 47 also includes an upper curved edge 51 coextensive of the planar member 40 and a trailing edge 52 that do not normally make engagement with the wooden member 2.

Figures 2, 3:
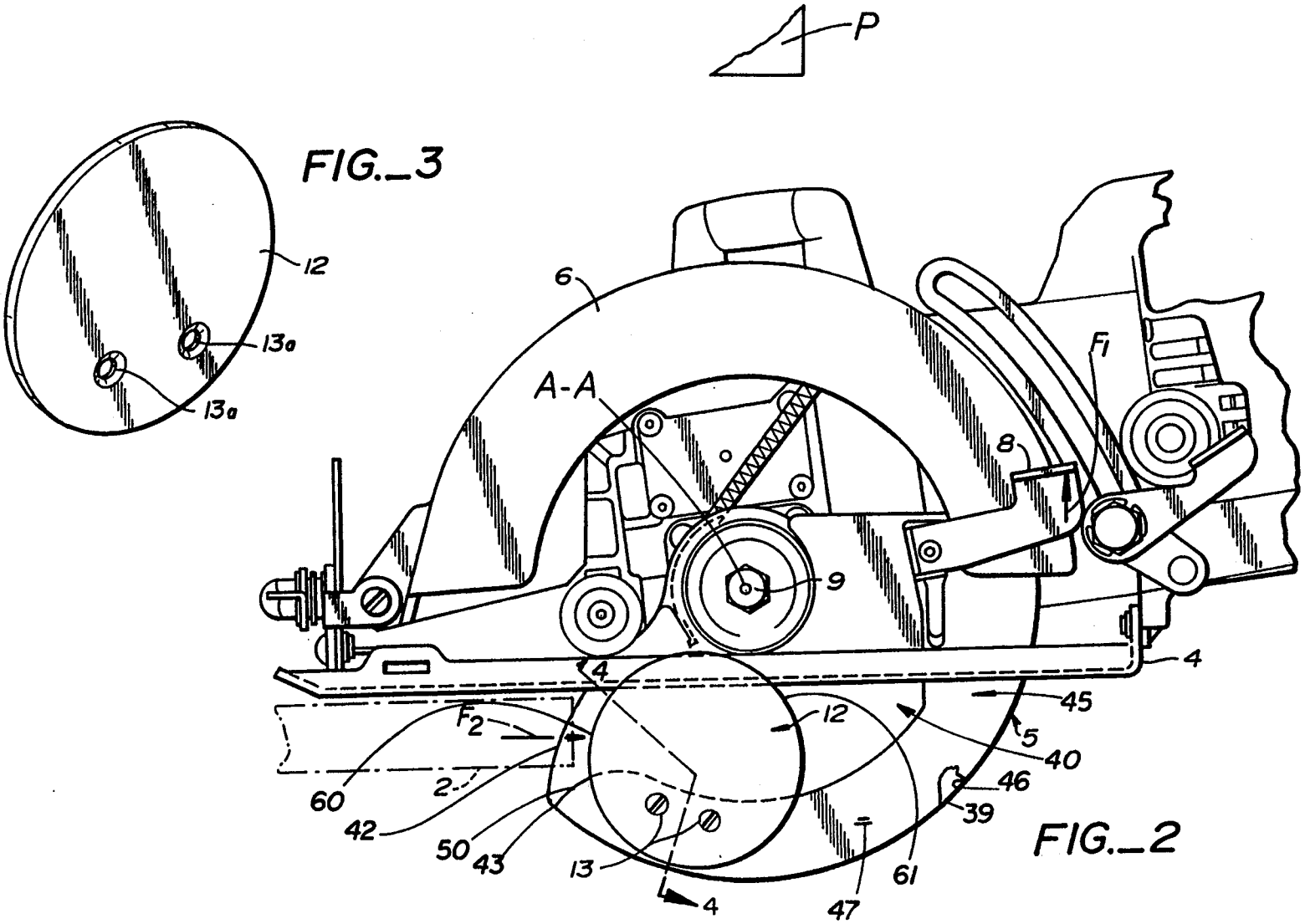
FIG. 2: Side view of machine showing guard improvement in place.
FIG. 3: Shows guard improvement separately.
Figure 5:
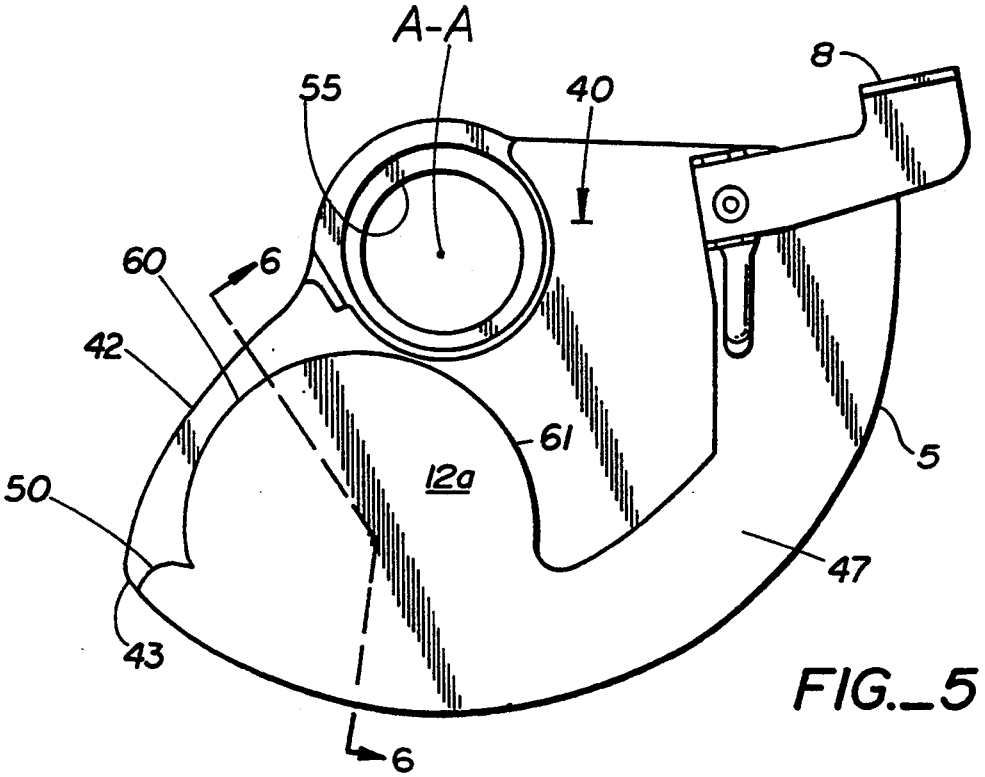
FIG. 5: Shows side view of lower guard member of FIG. 2 in position.

As shown in FIG. 2, the modified inner guard 5 includes a bulbous augmenter member 12 attached to and extending above the transverse leg 47, while in FIG. 5 the bulbous augmenter member **12*a* is integrally connected relative to the transverse let 47. In both augmenters 12, 12*a*, note that the inner guard 5 includes a central opening 55 concentric of axis of rotation A—A, see FIG. 5. In the relaxed position of guard 5 (in a state without application of outside forces), the augmenter 12, 12*a* each includes a forward leading edge 60 cantilevered and extending above the transverse leg 47 of the L-shaped flap segment 45 adjacent to forward edge 42 of the planar member 40 and a rearward edge 61 also cantilever above the transverse leg 47 but remote from the leading edge 60. The leading edge 60 and rearward edge 61 are formed by bisecting the augmenter 12 or 12*a* with a plane that passes through axis of rotation A—A and divides the augmenter 12, 12*a*** into equal areas.

As a result of the above, the augmenter member 12, **12*a* substantially increase the length of the leading edge 50 of the longitudinal and transverse legs 46, 47 of the saw 1 of FIG. 1 (via leading edge 60 of the augmenter 12, 12*a*) by a factor of at least 2 and preferably about 3 whereby the engagement extent with the wooden member 2 is substantially increased wherein jamming of the rotation of the inner guard 5 is prevented irrespective of position of the wooden member 2 with respect to the inner guard 5. In this regard, the leading edge 60 intersects the leading edge 50 at a location that is approximate ½ inch from the origin corner 43 of the forward edge 42 of the planar member 40 measured from a plane through the corner 43** that is normal to the working plane P.

In the operations as shown in FIG. 2, the inner guard 5 undergoes rotation in a counterclockwise direction along an arcuate path by application of force at either of two locations: force F1 to L-shaped controller 8 attached to flap segment 45 (by the hand of the use) and force F2 usually applied by the intersection of wooden member 2 with either (i) forward edge 42 of the planar member 40 or (ii) the combined leading edge 50, 60 of the augmenter 12, **12*a*** of the present invention.

Figure 4:
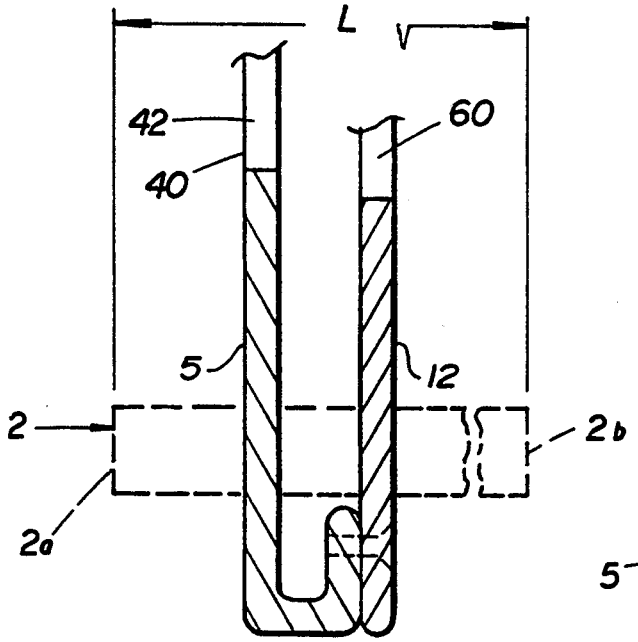
FIG. 4: In section along line 4—4 through FIG. 2 showing guard and removable improvement in position.
Figure 6:
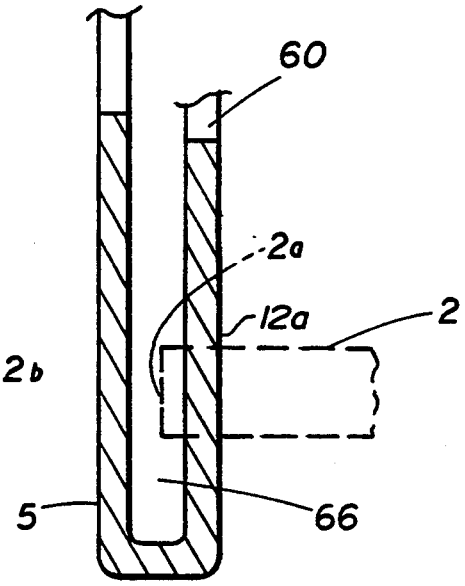
FIG. 6: Shows section along line 6—6 through FIG. 5.

In the latter situation, viz., item (i) or (ii), the shape and inclination of the wooden member 2 relative to the guard 5 dictates where the force F2 is applied. For cross cutting of a wooden member 2 having a length L between parallel side surfaces **2*a*, 2*b* see FIG. 4, wherein the side surfaces 2*a*, 2*b* define planes that are located on opposite sides of forward edge 42 of planar member 40 and the leading edge 60 of the augmenter member 12, the former usually makes first contact. But in the situation where side surface 2*a* (see FIG. 6) is interior of cavity 66 of the guard 5 and where the wooden member 2 extends through the plane of and is offset from the leading edge 60 of the augmenter member 12*a*, contact first occurs at leading edge 60 from contact with the wooden member 2** unlike inner guards of the prior art.

FIGS. 7–10 show another shapes of augmenters of the invention.

Figure 7:
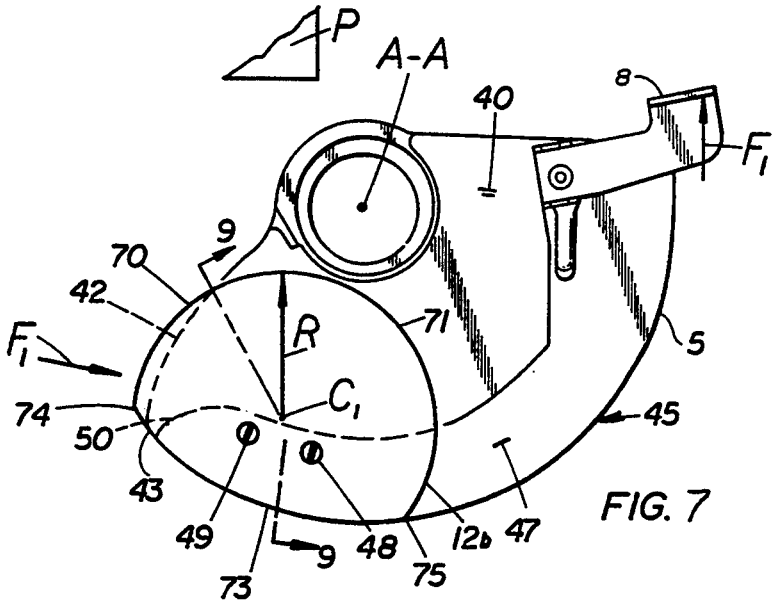
FIG. 7 is a side view of an alternate lower guard member.

As shown in FIG. 7, the bulbous augmenter **12*b* is about ⅛ inch thick and is of larger radius R, say about R=2 inches, than that previously shown, and defines a truncated annular shape that has a major center of formation C1 positioned above transverse leg 47 of the L-shaped flap segment 45. In FIG. 7, the bulbous augmenter 12*b* is of a truncated disk shape and is attached to transverse leg 47 via screws 48 extending through openings 49 so that in the relaxed position of guard 5 (in a state without application of outside forces), the augmenter 12*b* includes a leading edge 70 cantilevered and extending above and forward of the transverse let 47 as well as forward of the origin corner 43 of the forward edge 42 of the planar member 40, by about ⅜ inch. The augmenter 12*b* also includes a rearward edge 71 also cantilever above the transverse leg 47 but extending away from the forward edge 42 of the planar member 40. The forward leading edge 70 and rearward trailing edge 71 are defined by radius R centered at formation center C1 and meet along a plane that bisectes the augmenter 12*b* into equal parts, such plane passing through axis of rotation A—A. Such plane also divides circular terminal edge 73 that intersects the leading and trailing edges 70, 71 at corners 74, 75, into equal lengths. Such edge 73** has a minor center of formation coincident with axis of rotation A—A.

As a result of the above, the augmenter member 12b substantially increases the length of the leading edge 50 previously attained by the L-shaped flap member 45 by a factor of at least 2 and preferably about 4 whereby the engagement extent of the inner guard 5 is substantially increased. Such elongation is, of course, due to the positioning of leading edge 70 of the bulbous augmenter 12b well forward of the leading edge 50 wherein jamming of the rotation of the inner guard 5 is prevented irrespective of position of the wooden member with respect to the inner guard 5. Furthermore, the leading edge 70 also extends approximate ⅜ inch beyond from the origin corner 43 of the forward edge 42 of the planar member 40 measured from a plane through the corner 43 that is normal to the working plane P. Thus, the frequency of initiation of rotation of the inner guard 5 by contact with the leading edge 70 with the wooden member (as opposed to contact with leading edge 42 of the planar member 40), is also substantially increased.

Figure 8:
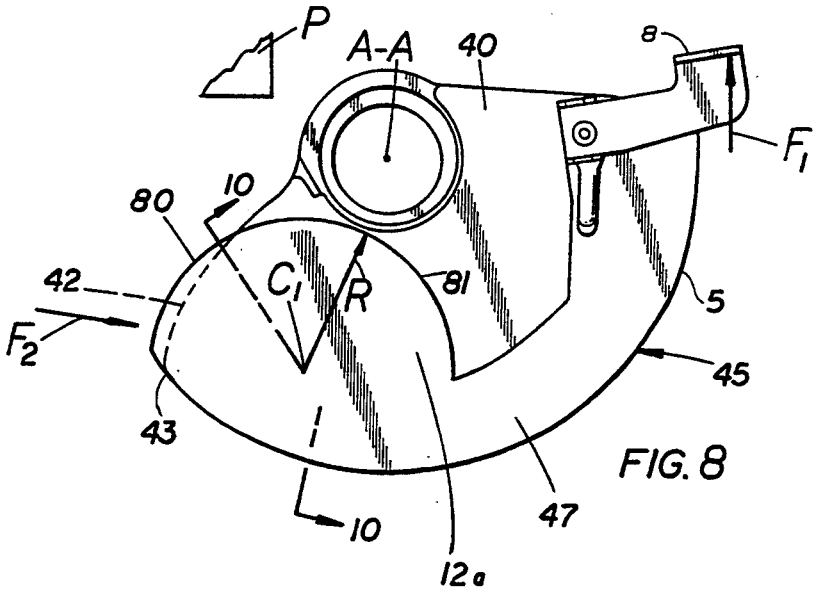
FIG. 8 is a side view of another alternate lower guard member.

As shown in FIG. 8, the bulbous augmenter 12c of the modified guard 5 is integrally formed relative to the transverse leg 47 in the same position as shown in FIG. 7. The augmenter 12c is of similar shape and design as that depicted in FIG. 7, except it extends from the transverse leg 47 in the same plane. As a result, forward leading edge 80 is of similar length but trailing edge 81 is shortened. However, the edges 80, 81 are still defined by radius R having a major center of formation C1 position above transverse leg 47 of L-shaped flap segment 45 so that in the relaxed position of guard 5 (in a state without application of outside forces), the forward leading edge 80 cantilevers and extends above and forward of both the transverse leg 47 and the forward edge 42 of the planar member 40, by ⅜ inch or so. The trailing edge 81 also cantilevers above the transverse leg 47 but extends away from the forward edge 42 of the planar member 40. The leading edge 80 and the trailing edge 81 are formed by bisecting the augmenter 12c with a plane that passes through axis of rotation A—A and divides the augmenter 12c into equal areas.

As a result of the above, the augmenter member 12c substantially increases the length of the leading edge previously attained by the L-shaped flap member 45 (via leading edge 80 of the augmenter 12c) by a factor of at least 2 and preferably about 4 whereby the engagement extent is substantially increased wherein jamming of the rotation of the inner guard 5 is prevented irrespective of position of the wooden member with respect to the inner guard 5.

In operations, the inner guard 5 of FIGS. 7 and 8 undergoes rotation in a counterclockwise direction by application of force at either of two locations: force F1 to L-shaped controller 8 (by the hand of the user) and force F2 usually applied by the intersection of wooden member 2 with either (i) forward edge 42 of the planar member 40 or (ii) the forward curved edge 70, 80 of the augmenter 12b, 12c, respectively. In the latter situation, viz., item (i) or (ii), the shape and inclination of the wooden member relative to the guard 5 dictates where the force F2 is applied.

Figure 9:
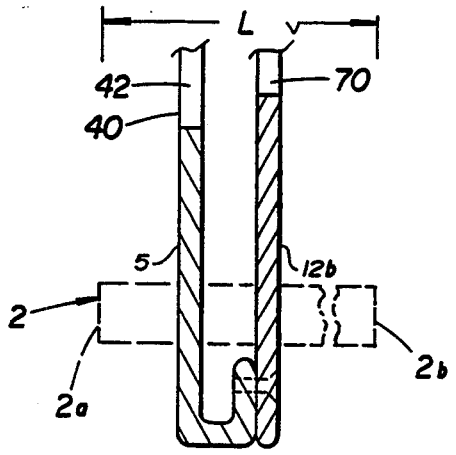
FIGS. 9 and 10 are sections taken along lines 9—9 and 10—10 of FIGS. 7 and 8, respectively.
Figure 10:
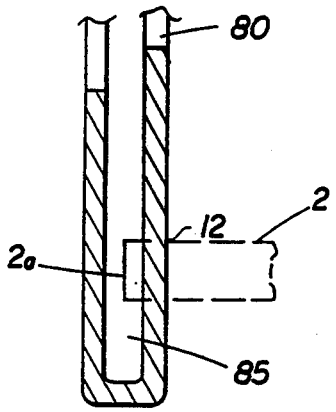

For cross cutting of a wooden member 2 having a length L between parallel side surfaces 2a, 2b see FIG. 9, side surfaces 2a, 2b define planes that are located on opposite sides of forward edge 42 of the planar member 40 and curved edge 70. Thus in normal situations, the curved edge 70 usually makes first contact except in the situation where the wooden member 2 is rotated in a clockwise direction in FIG. 7 and thus is outwardly canted relative to the guard 5. Also in the situation where side surface 2a (see FIG. 10) is interior of cavity 85 and the wooden member 2 extends through the plane of and is offset from curved edge 80 of the augmenter 12c, contact first occurs from the curved edge 80 with the wooden member 2 unlike inner guards of the prior art.

Although preferred embodiments of the invention have been described hereinbefore, it should be appreciated that variations, changes and modifications thereof are readily apparent to those skilled in the art and such variations, changes and modifications could be made without departing from the spirit of the invention.

What is claimed is:

1. A portable, circular saw including a saw blade selectively rotatable about an axis of rotation to a define a working plane normal to said axis of rotation, an arcuate outer upper guard fixedly mounted about a first sector of said blade of a selected arcuate angle A1 relative to said axis of rotation, an inner lower guard having a central opening concentric of said axis of rotation of said blade, said inner lower guard being rotatably mounted about a second sector of said blade on a side opposite to said first sector of angular dimension A2 wherein said blade is clear of said inner and outer guards over a cutting sector of angular dimension A3, said cutting sector being capable of expansion as a function of force generated by contact between a wooden member and said inner lower guard wherein said inner lower guard undergoes rotation about said axis of rotation, the amount of said displacement being a function of force applied to said inner lower guard, said inner lower guard also comprising two upright section members each having a leading edge and a trailing edge in a relaxed state of said saw, and a transverse section surrounding at least a portion of blade teeth of said saw wherein one of said upright sections is rotatable attached to said saw and the other section depends from said one section through said transverse section.

a bulbous member to prevent the work item being cut from jamming against said trailing edge of said other of said upright sections of said lower guard of said circular saw and preventing rotational motion of said lower guard;

said bulbous member comprising a disc fixedly attached to said other of said upright sections of said lower guard, said disc having a diameter that is at least twice the total upright extent of said other section of said lower guard so as to substantially increase vertical extent of the leading edge of said other section of said lower guard in said relaxed state of said saw so as aid the circular movement of said lower guard and prevent jamming thereof.

2. The portable, circular saw of claim 1 in which said disc is located in close proximity to said leading edge of said other of said upright sections of said lower guard wherein its leading circumferential edge intersects said leading edge of said other section and extends thereabove at a point that is downstream of said leading edge of said other section at a location of about ½ inch behind said origin corner of said leading edge of said other section measured from a plane normal to said working plane of said blade.

3. The portable, circular saw of claim 2 in which said disk is approximately ⅛ inch thick and approximately 2¾ inches in diameter.

4. The portable, circular saw of claim 1 in which said bulbous member is attached to said transverse leg of said L-shaped member of said inner guard by screws.

5. The portable, circular saw of claim 1 in which said circular disc and said other of said upright sections of said lower guard comprise a single piece.

6. The portable, circular saw of claim 1 in which said leading edge of said circular disc intersects said leading edge of said other section and extends thereabove at a point that is downstream of said leading edge of said other section at a location that about ½ inch behind said origin corner of said leading edge of said other section wherein said circular disc is truncated so that said leading edge thereof swings upward from said downstream point to a maximum location that is about ⅜ inch forward of said downstream point of said truncated disc.

7. The portable, circular saw of claim 6 in which said truncated disk is approximately ⅛ inch thick and a radius of about 2 inches.

8. The portable, circular saw of claim 1 with the addition of a saw housing having a front section and a rear section that includes a handle for hand manipulation thereof, said housing being capable of undergoing rectilinear motion relative to said wooden member to be cut, and a motor having a shaft attached to said housing and releasably attached to said saw blade.

9. The portable, circular saw of claim 8 in which said angle A1 associated with said first sector of said saw blade is about 180 degrees, said angle A2 associated with said second sector is about 120 degrees and said angle A3 associated with said cutting sector is about 60 degrees.

10. The portable, circular saw of claim 1 in which leading edge of said circular disc increases the engaging extend of said leading edge of said other section by a factor of a least 3.

11. The portable, circular saw of claim 1 in which said leading edge of said bulbous member increases the engaging extent of said forward leading edge of said transverse and longitudinal legs by a factor of at least 4.

12. In a portable, circular saw including a saw blade selectively rotatable about an axis of rotation to a define a working plane normal to said axis of rotation, an arcuate outer upper guard fixedly mounted about said blade on one side of said blade, an inner lower guard having a central opening concentric of said axis of rotation of said blade, rotatably mounted about an opposite side of said blade, said inner lower guard also comprising two upright section members each having a leading edge and a trailing edge in a relaxed state of said saw, and a transverse section surrounding at least a portion of blade teeth of said saw wherein one of said upright sections is rotatable attached to said saw and the other section depends from said one section through said transverse section, the combination comprising a wooden member to be cut by said blade, said wooden member generating a force on said inner lower guard as said wooden member makes contact therewith whereby said inner lower guard undergoes rotation about said axis of rotation, the amount of rotation being a function of force applied to said inner lower guard, a bulbous member attached to said inner lower guard to define a leading edge that substantially increases the engaging extent of said inner guard to cause rotation, and to prevent said wooden member being cut from jamming against said trailing edge of said other of said upright sections of said lower guard of said circular saw and preventing rotatinal motion of said lower guard;

said bulbous member comprising a disc fixedly attached to said other of said upright sections of said lower guard, said disc having a diameter that is at least twice the total upright extent of said other section of said lower guard so as to substantially increase vertical extent of the leading edge of said other section of said lower guard in said relaxed state of said saw so as aid the circular movement of said lower guard whereby jamming of said rotation of inner lower guard is prevented irrespective of position of said wooden member with respect to said inner lower guard.

13. The combination of claim 12 in which said disc is located in close proximity to said leading edge of said other of said upright sections of said lower guard wherein its leading edge intersects said leading edge of said other section and extends thereabove at a point that is downstream of said leading edge of said other section at a location of about ½ inch behind said origin corner of said leading edge of said other section measured from a plane normal to said working plane of said blade.

14. The combination of claim 12 in which said leading edge of said circular disc intersects said leading edge of said other section and extends thereabove at a point that is downstream of said leading edge of said other section at a location that about ½ inch behind said origin corner of said leading edge of said other section wherein said circular disc is truncated so that said leading edge thereof swings upward from said downstream point to a maximum location that is about ⅜ inch forward of said downstream point of said truncated disc.

15. The combination of claim 12 in which said wooden member comprises a first side surface adjacent to a region to be trimmed, said first side surface being located within said said transverse section of said inner lower guard wherein one of said upright sections is rotatable attached to said saw and the other section depends from said one section through said transverse section, whereby said circular disc contacts said wooden member as said first side surface is being trimmed and prevents jamming of said inner lower guard.

16. In a portable, circular saw including a saw blade selectively rotatable about an axis of rotation to a define a working plane normal to said axis of rotation, an arcuate outer upper guard fixedly mounted about said blade on one side of said blade, an inner lower guard having a central opening concentric of said axis of rotation of said blade, rotatably mounted about an opposite side of said blade, said inner lower guard also comprising two upright section members each having a leading edge and a trailing edge in a relaxed state of said saw, and a transverse section surrounding at least a portion of blade teeth of said saw therein one of said upright sections is rotatable attached to said saw and the other section depends from said one section through said transverse section, the improvement comprising a bulbous member attached to said inner lower guard to define a leading edge that substantially increases the engaging extent of said inner lower guard to cause rotation, and to prevent a wooden member being cut form jamming against said trailing edge of said other of said upright sections of said lower guard of said circular saw and preventing rotational motion of said lower guard;

said bulbous member comprising a disc fixedly attached to said other of said upright sections of said lower guard, said disc having a diameter that is at least twice the total upright extent of said other section of said lower guard so as to substantially increase vertical extent of the leading edge of said other section of said lower guard in said relaxed state of said saw so as aid the circular movement of said lower guard whereby jamming of said rotation of inner lower guard is prevented irrespective of position of said wooden member to be cut relative to said inner lower guard.

17. The improvement of claim 16 in which said disc is located in close proximity to said leading edge of said other of said upright sections of said lower guard wherein its leading circumferential edge intersects said other section and extends thereabove at a point that is downstream of said leading edge of said other section at a location behind said origin corner of said leading edge of said other section measured from a plane normal to said working plane of said blade.

18. The improvement of claim 16 in which said leading edge of said circular disc intersects said leading edge of said other section and extends thereabove at a point that is downstream of said leading edge of said other section at a location that is behind said origin corner of said leading edge of said other section wherein said circular disc is truncated so that said leading edge thereof swings upward from said downstream point to a maximum location that is cantilevered forward of said downstream point of said of said truncated disc measured relative to a plane normal to said working plane of said blade.

* * * * *